US008921722B2

(12) United States Patent
Huang et al.

(10) Patent No.: US 8,921,722 B2
(45) Date of Patent: Dec. 30, 2014

(54) ASSEMBLY RECEPTACLE CAPABLE OF SEPARATING

(75) Inventors: Fu-Hsiang Huang, Taichung (TW); Chang-Chin Yang, Taichung (TW)

(73) Assignee: Chao-Sheng Kuo, Taichung (TW)

( * ) Notice: Subject to any disclaimer, the term of this patent is extended or adjusted under 35 U.S.C. 154(b) by 273 days.

(21) Appl. No.: 13/350,566

(22) Filed: Jan. 13, 2012

(65) Prior Publication Data

US 2012/0184119 A1 Jul. 19, 2012

(30) Foreign Application Priority Data

Jan. 17, 2011 (TW) ..... 100101680 A

(51) Int. Cl.

| | |
|---|---|
| ***H01H 9/20*** | (2006.01) |
| ***H01R 25/00*** | (2006.01) |
| ***H01H 23/08*** | (2006.01) |
| ***H01R 13/70*** | (2006.01) |
| ***H01R 29/00*** | (2006.01) |

(52) U.S. Cl.

CPC ..... *H01R 25/00* (2013.01); *H01H 23/08* (2013.01); *H01R 13/70* (2013.01); *H01R 29/00* (2013.01)

USPC ..... 200/51.04

(58) Field of Classification Search

CPC ..... H01H 23/08

USPC ..... 200/51 R, 51.02–51.04, 339, 553–555, 200/5 A, 6 R, 6 C, 18

See application file for complete search history.

(56) References Cited

U.S. PATENT DOCUMENTS 6,392,171 B1 * 5/2002 Linhuang ..... 200/51.02
8,011,940 B1 9/2011 Wu

* cited by examiner

*Primary Examiner* — Felix O Figueroa

(74) *Attorney, Agent, or Firm* — Muncy, Geissler, Olds & Lowe, P.C.

(57) ABSTRACT

An assembly receptacle capable of separating includes an assembly set which has a first assembling slot, a second assembling slot and a third assembling slot, a first connection set with a first connecting element which is installed in the first assembling slot and includes a connecting portion and at least one plug connecting portion, a second connection set with a first connecting portion installed in the second assembling slot and a second connecting portion installed in the third assembling slot, and an actuation portion to control electric connection or disconnection between the first connecting portion and the second connecting portion. The second connecting portion is connected to the plug connecting portion.

10 Claims, 6 Drawing Sheets

ASSEMBLY RECEPTACLE CAPABLE OF SEPARATING

FIELD OF THE INVENTION

The present invention relates to a power receptacle and particularly to an assembly receptacle capable of separating.

BACKGROUND OF THE INVENTION

Conventional power receptacle, such as U.S. Pat. No. 8,011,940 discloses a first polar member, a second polar member, a connecting member, and a detachable connecting reed mounted onto the connecting member. The aforesaid elements are assembled in two or more than two plastic casings to be fixedly positioned and electrically insulated.

As two or more than two plastic casings are needed to hold the elements, a greater amount of costs incurs to production, material preparation and stocks, and management is more difficult. Assembly is more complicated and time-consuming. Assembly accuracy suffers and easily results in unstable assembly of the elements. There is still room for improvement.

SUMMARY OF THE INVENTION

The primary object of the present invention is to provide an assembly receptacle capable of separating that includes an assembly set to hold various types of components such as connecting elements and connecting reeds.

To achieve the foregoing object, the assembly receptacle of the invention includes an assembly set, a first connection set, a second connection set and an actuation portion. The assembly set includes a first assembling slot, a second assembling slot and a third assembling slot. The first assembling slot has a first slot opening and a first retaining portion. The second assembling slot has a second slot opening and a second retaining portion. The third assembling slot has a third slot opening. The first connection set includes a first connecting element installed in the first assembling slot via the first slot opening. The first connecting element has a connecting portion and at least one plug connecting portion. The second connection set includes a first connecting portion and a second connecting portion. The first connecting portion is installed in the second assembling slot via the second slot opening, and the second connecting portion is installed in the third assembling slot via the third slot opening. The second connecting portion is connected to the plug connecting portion. The actuation portion controls electric connection or disconnection between the first connecting portion and second connecting portion.

By means of the aforesaid technique, the invention provides many benefits, notably:

1. Production costs are lower and poor positioning problem can be reduced.

2. The problems of production, material preparation and stocks incurring to different types of casings can be eliminated.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
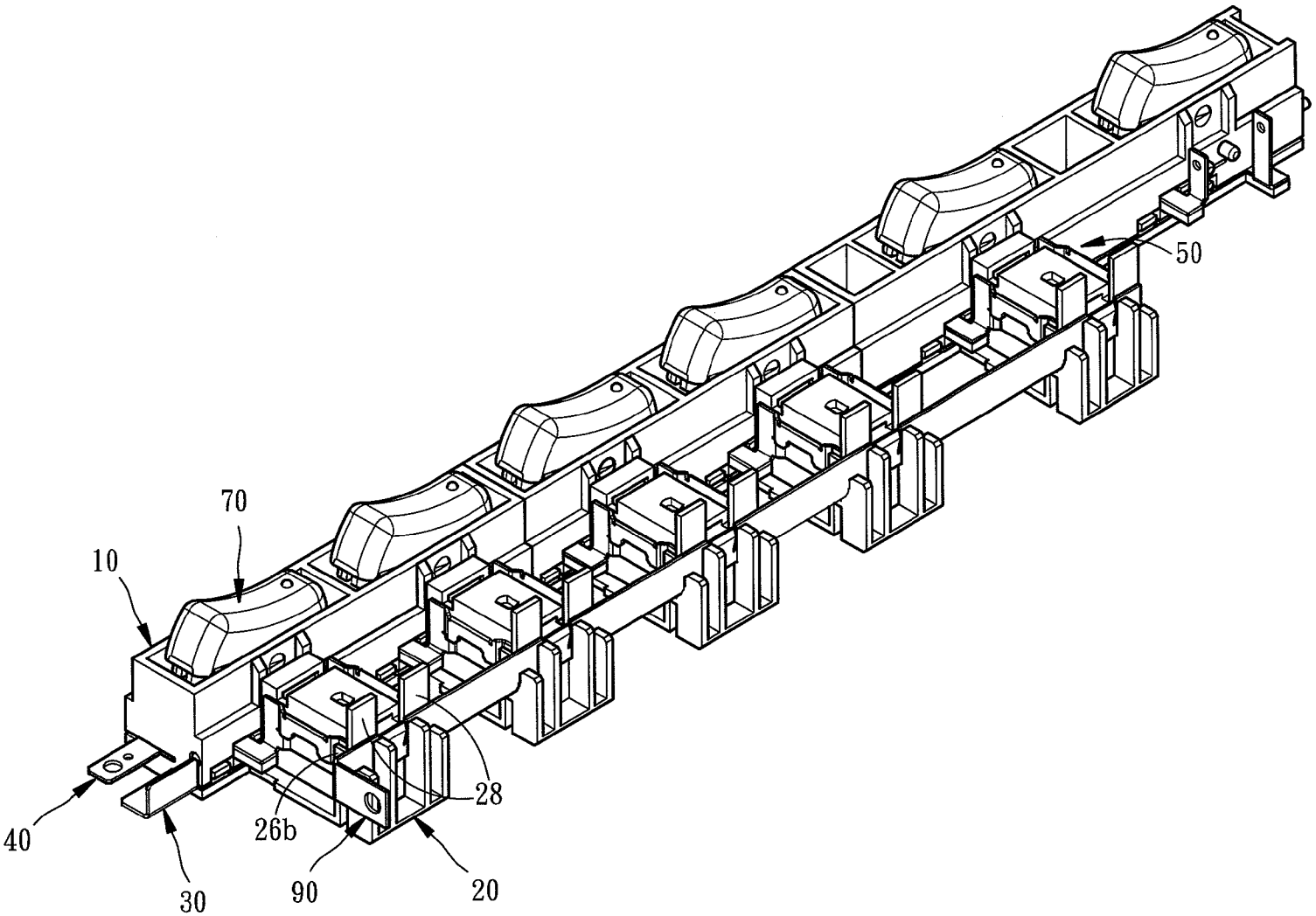
FIG. 1 is a perspective view of an embodiment of the invention.
Figure 2:
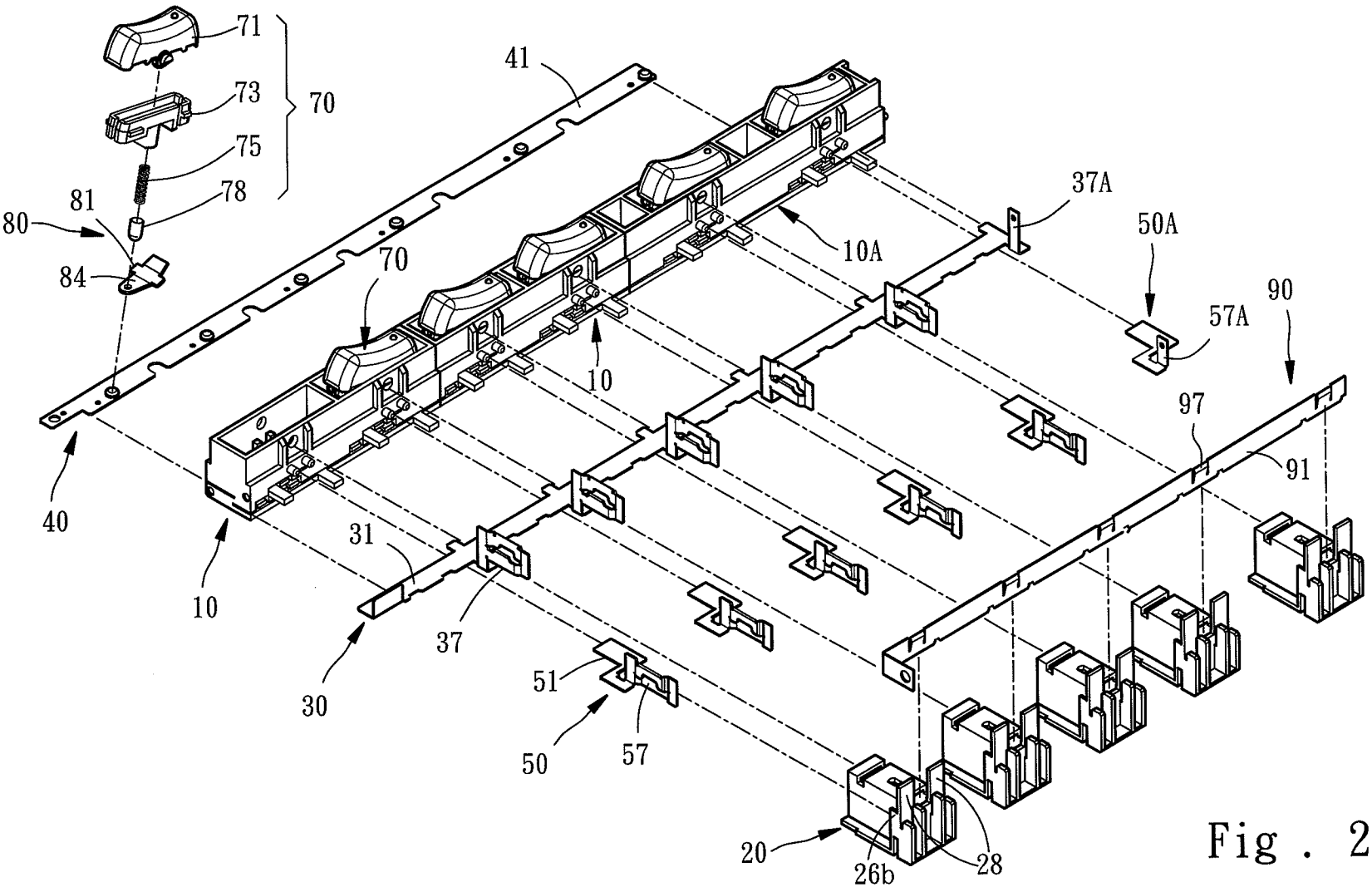
FIG. 2 is an exploded view of an embodiment of the invention.

Please refer to FIGS. 1 through 8 for an embodiment of the assembly receptacle capable of separating according to the invention. It includes an assembly set which includes a primary holder 10 and a secondary holder 20 transversely coupled with the primary holder 10.

The primary holder 10 includes secondary holder connecting portions 12 which are struts, a first assembling slot 13 with a first slot opening 131, a second assembling slot 14 with a second slot opening 141, a third assembling slot 15 with a third slot opening 151, a first connecting element support portion 16, a second connecting element support portion 17, a connecting reed branch portion 181 and a communicating hole 183. The first slot opening 131 and second slot opening 141 are on two opposite sides and formed transversely.

The first assembling slot 13 has a first retaining portion 133, the second assembling slot 14 has a second retaining portion 143 and the third assembling slot 15 has a third retaining portion 153. The primary holder 10 has a bottom side and two lateral sides. The first, second and third assembling slots 13, 14 and 15 are formed on the two lateral sides of the primary holder 10 and parallel with the bottom side of the primary holder 10.

The first and third assembling slots 13 and 15 are located at the same side. The third assembling slot 15 communicates with the second assembling slot 14, but is formed at an elevation different from that of the second assembling slot 14.

The secondary holder 20 has a primary holder connecting portion 21 which is a hole coupled with the secondary holder connecting portion 12. The secondary holder 20 further has a plug connecting portion butting surface 27 and a ground connecting plate holding slot 29. The plug connecting portion butting surface 27 is extended upwards to form two corresponding detent portions 26*a* and 26*b*. The two detent portions 26*a* and 26*b* and the ground connecting plate holding slot 29 are interposed by a protrusive spacer 28.

The assembly receptacle of the invention also includes a first connection set, a second connection set and a ground connection plate 90. The first connection set has a first connecting element 30 installed in the first assembling slot 13 via the first slot opening 131. The first connecting element 30 includes a connecting portion 31 and a plurality of plug connecting portions 37 and 37*a*.

The second connection set includes a first connecting portion 41, a second connecting portion 51, plug connecting portions 57 and 57A, and an actuation portion 781. The first connecting portion 41 is installed in the second assembling slot 14 via the second slot opening 141, and the second connecting portion 51 is installed in the third assembling slot 15 via the third slot opening 151. The plug connecting portion 57 is connected to the second connecting portion 51 and has one end remote from the second connecting portion 51 interposed between the two detent portions 26*a* and 26*b*. The actuation portion 781 controls electric connection or disconnection between the first connecting portion 41 and second connecting portion 51.

The second connection set has a third connecting portion 84 butted by the actuation portion 781 to form electric connection between the first connecting portion 41 and second connecting portion 51.

In addition, the second connection set has a second connecting element 40. The first connecting portion 41 is coupled on the second connecting element 40. The second connection set also includes a plurality of insertion couplers 50 coupled with the second connecting portion 51 and a plurality of switch sets 70 each of which has a pushbutton 71, a button base shell 73, an elastic butting member 75 and a control member 78. The actuation portion 781 is formed on the control member 78 of the switch set 70. The second connection set also has a plurality of connecting reeds 80 each of which has an anchor portion 81 installed on the connecting reed branch portion 181 of the primary holder 10 to form the third connecting portion 84.

The ground connecting plate 90 has a connecting portion 91 located in the ground connecting plate holding slot 29 of the secondary holder 20 and a plurality of plug connecting portions 97 connected by the plugs (not show in the drawings) for grounding. The connecting portion 91 is spaced from the plug connecting portion 57 via the spacer 28.

Figure 3:
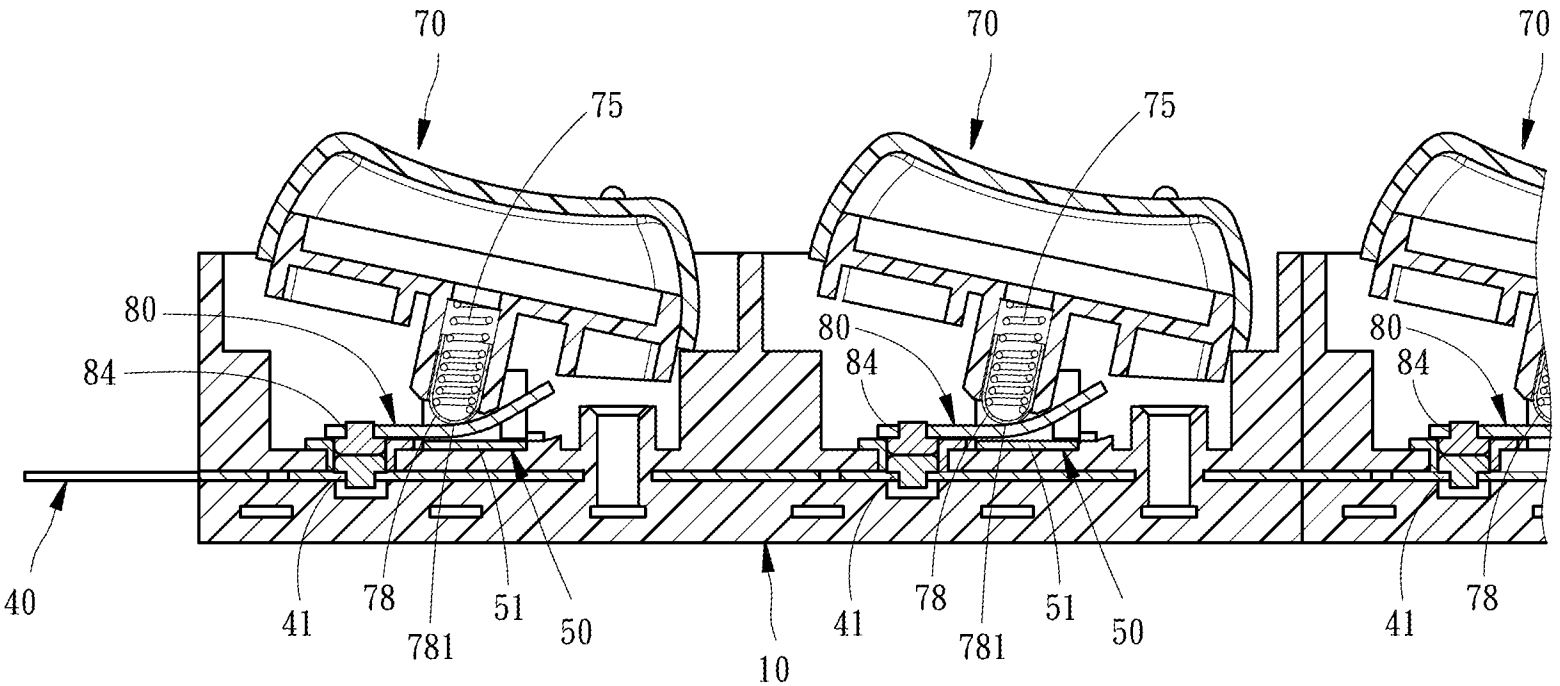
FIG. 3 is a front sectional view of an embodiment of the invention in an assembly condition.
Figure 4:
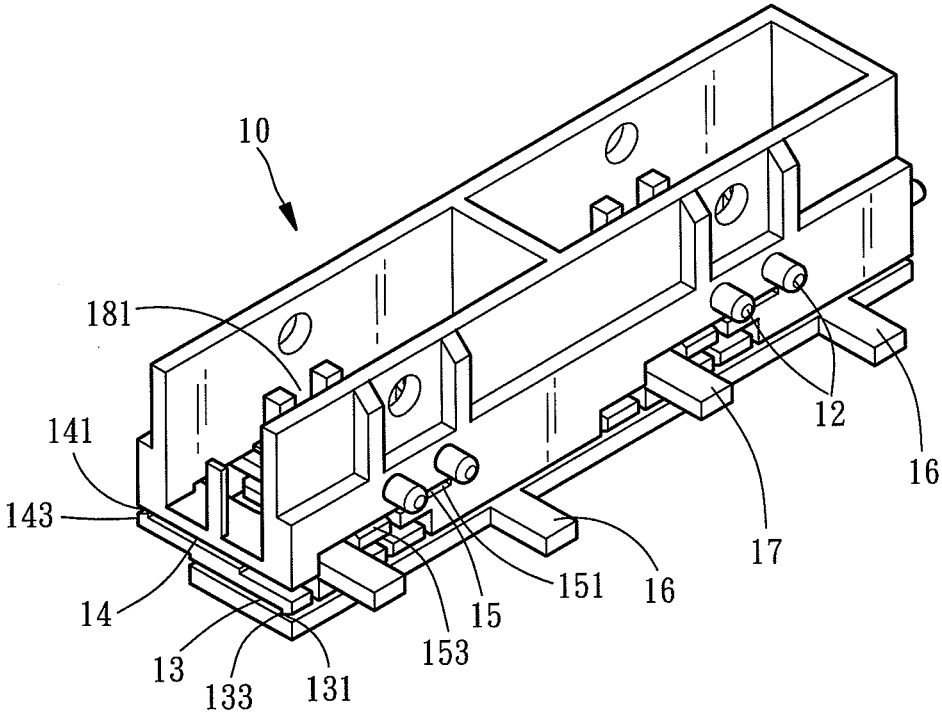
FIG. 4 is a perspective view of an embodiment of a primary holder of the invention.
Figure 5:
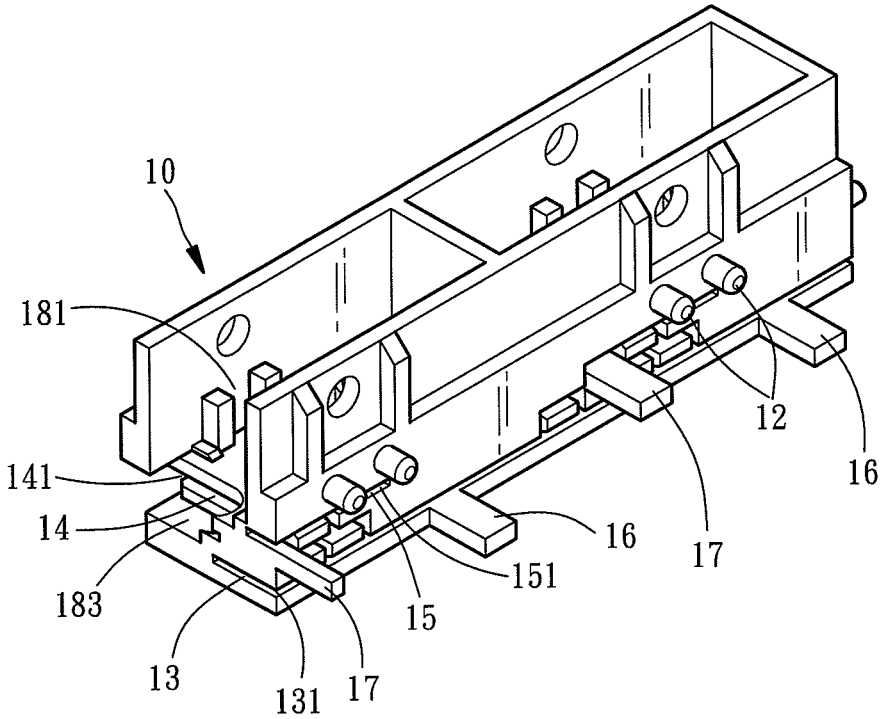
FIG. 5 is a perspective view of another embodiment of the primary holder of the invention.
Figure 6:
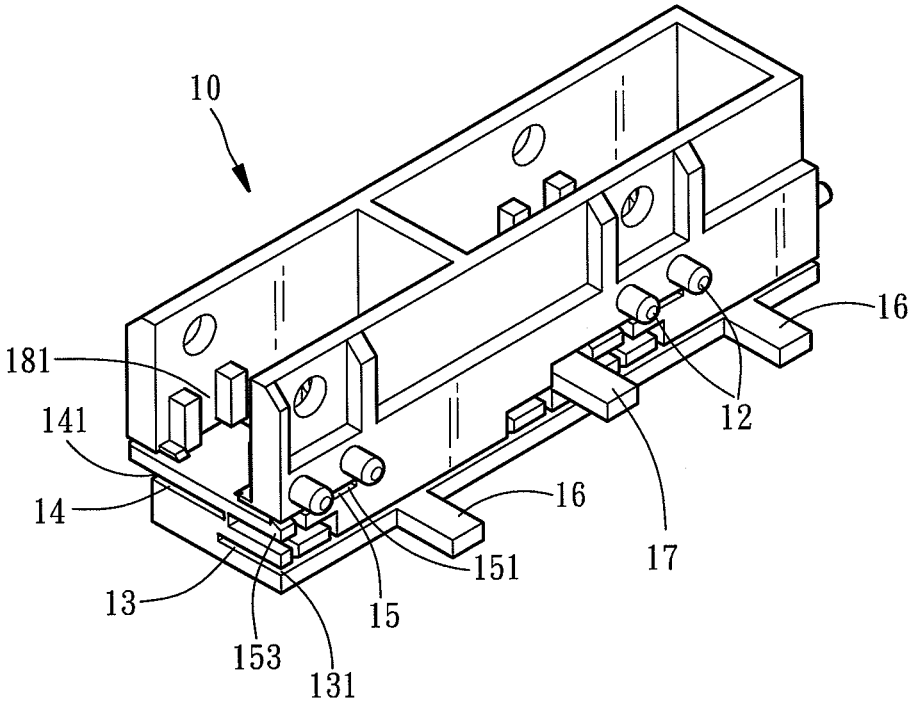
FIG. 6 is a perspective view of yet another embodiment of the primary holder of the invention.
Figure 7:
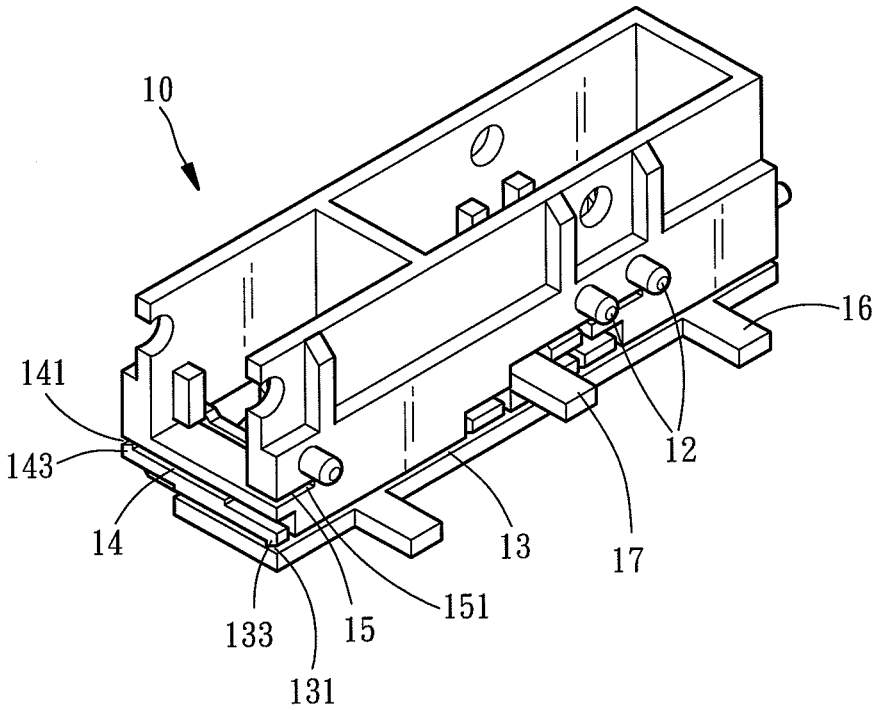
FIG. 7 is a perspective view of still another embodiment of the primary holder of the invention.
Figure 8:
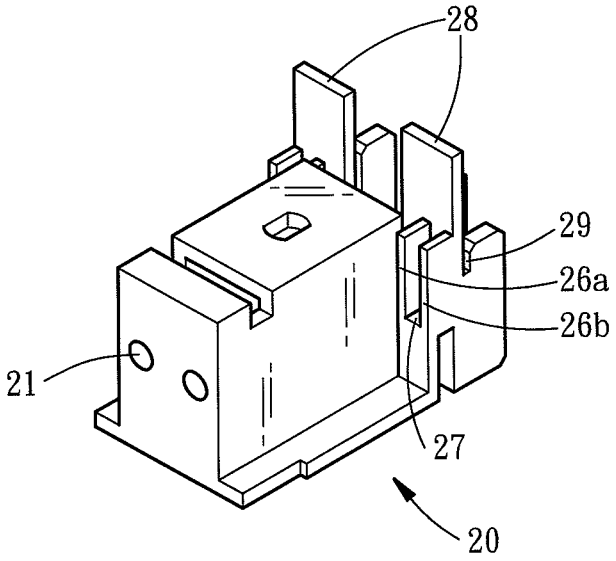
FIG. 8 is a perspective view of an embodiment of the secondary holder of the invention.

The assembly receptacle of the invention, in practical structure and use, includes features as follows:

In the ON state, referring to FIG. 3, the actuation portion 781 of the switch set 70 is pressed such that the third connecting portion 84 of the connecting reed 80 contacts the first connecting portion 41 of the second connecting element 40 and the second connecting portion 51 of the insertion couplers 50 and 50A at the same time. On the other hand, when the switch set 70 is in the OFF state, disconnection is formed between the first connecting portion 41 and the second connecting portion 51.

For assembly of the invention, the first connecting element 30, second connecting element 40 and insertion couplers 50 and 50A can be mounted freely onto the primary holder 10 without interfering each other. Through the first assembling slot 13, second assembling slot 14 and third assembling slot 15, the first connecting element 30, second connecting element 40 and insertion couplers 50 and 50A can be insulated from each other without incurring short circuit and mistake contact. The first connecting element 30, second connecting element 40 and insertion couplers 50 and 50A are positioned respectively and securely via the first retaining portion 133, second retaining portion 143 and third retaining portion 153. Hence the primary holder 10 provides a simplified structure and can improve practicality.

It is to be noted that the element structures previously discussed can be interchanged to form varying configurations and combinations in practice.

For instance, aside from positioning the first assembling slot 13 and second assembling slot 14 at opposite sides, they also can be located at the same side. Besides, the third assembling slot 15, in addition to holding the second connecting portion 51, also can hold the insertion coupler 50A. Moreover, aside from positioning the third assembling slot 15 and second assembling slot 14 at opposite sides, they also can be located at the same side.

Furthermore, apart from the third assembling slot 15 being formed at an elevation different from that of the first assembling slot 13 or second assembling slot 14, the third assembling slot 15 also can be formed at the same elevation as that of the second assembling slot 14.

The third connecting portion 84, aside from being an independent element (i.e. being the connecting reed 80), can also be omitted to become another element located in the switch set 70, or be coupled with or integrally formed with the second connecting element 40 or insertion coupler 50.

Moreover, the first retaining portion 133, second retaining portion 143 and third retaining portion 153 may also be omitted and replaced by the secondary holder 20. In other words, the function of the first retaining portion 133 or second retaining portion 143 can be achieved by clamping the first connecting element 30 and insertion coupler 50 via the primary holder 10 and secondary holder 20. Of course, the assembly set may also have a casing (not shown in the drawings) to hold the primary holder 10 and/or the secondary holder 20 or to incorporate with the primary holder 10 to clamp the second connecting element 40 to achieve the function provided by the second retaining portion 143.

The ground connection blade 90 also can be omitted when no grounding is required, and the secondary holder 20 can also be retained or dispensed with according to requirements.

As a conclusion, the assembly receptacle according to the invention allows various elements such as connecting elements and connecting reeds to be held in the same assembly set, thereby higher assembly costs and poor positioning problem can be reduced, and other problems of production, material preparation and stocks incurring to different types of casings also can be eliminated.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An assembly receptacle capable of separating, comprising:

an assembly set including a first assembling slot with a first slot opening and a first retaining portion, a second assembling slot with a second slot opening and a second retaining portion, and a third assembling slot with a third slot opening;

a first connection set including a first connecting element installed in the first assembling slot via the first slot opening, the first connecting element including a connecting portion and at least one first plug connecting portion;

a second connection set including a second connecting element, at least one insertion coupler and a plurality of connecting reeds, the second connecting element being installed in the second assembling slot via the second slot opening, the at least one insertion coupler being installed in the third assembling slot via the third slot opening, the second connecting element including a first connecting portion, the at least one insertion coupler including a second connecting portion and a second plug connecting portion connected to the second connecting portion, each of the plurality of connecting reeds including an anchor portion which is formed at a sheet shape and extended outwards from two sides of the connecting reed in a direction perpendicular to a longitudinal direction of the connecting reed to electrically connect to the second connecting portion through a surface thereof and a third connecting portion which is controllable by an actuation portion to form electric connection or disconnection between the first connecting portion and the second connecting portion, wherein the anchor portion and the third connecting portion respectively forming surface contact with the second connecting portion and the first connecting portion during forming the electric connection.

2. The assembly receptacle of claim 1, wherein the third assembling slot includes a third retaining portion.

3. The assembly receptacle of claim 1, wherein the first assembling slot and the second assembling slot are located at opposite sides.

4. The assembly receptacle of claim 1, wherein the third assembling slot and the second assembling slot are located at opposite sides.

5. The assembly receptacle of claim 1, wherein the third assembling slot and the first assembling slot are located at a same side.

6. The assembly receptacle of claim 1, wherein the third assembling slot and the second assembling slot are formed at a same elevation.

7. The assembly receptacle of claim 1, wherein the third assembling slot and the second assembling slot are formed at different elevations.

8. The assembly receptacle of claim 1, wherein the second connection set includes at least one switch set and the third connecting portion butted by the actuation portion which is located in the switch set.

9. The assembly receptacle of claim 1, wherein the assembly set includes at east one lateral side where the first assembling slot or the second assembling slot is formed.

10. The assembly receptacle of claim 1, wherein the assembly set includes at least one bottom side parallel with the first assembling slot or the second assembling slot.

* * * * *